US005216462A

United States Patent [19]

Nakajima et al.

[11] Patent Number: 5,216,462

[45] Date of Patent: Jun. 1, 1993

[54] TONER RESIDUAL AMOUNT DETECTING MECHANISM

[75] Inventors: Shigeki Nakajima; Masato Takano; Yoshiharu Momiyama; Hiroshi Kikuchi; Yukio Ota, all of Tokyo, Japan

[73] Assignee: Oki Electric Industry Co., Ltd., Tokyo, Japan

[21] Appl. No.: 907,646

[22] Filed: Jul. 2, 1992

[30] Foreign Application Priority Data

Jul. 4, 1991 [JP] Japan ..... 3-164558

[51] Int. Cl.[5] ..... G03G 15/08

[52] U.S. Cl. ..... 355/203; 73/290 V; 118/694; 222/DIG. 1; 340/617

[58] Field of Search ..... 355/203, 205, 206, 245-246; 118/694; 222/DIG. 1; 340/617; 73/290 R

[56] References Cited

U.S. PATENT DOCUMENTS 4,003,258 1/1977 Suzuki ..... 73/290 R
4,592,642 6/1986 Imaizumi et al. ..... 355/205
4,989,754 2/1991 Grasso et al. ..... 222/DIG. 1 X

FOREIGN PATENT DOCUMENTS 60-107664 6/1985 Japan ..... 355/245

OTHER PUBLICATIONS

*Xerox Disclosure Journal,* vol. 10, No. 2, Mar./Apr. 1985, Poehlein, Raymond E., "Low Toner Sensor", pp. 93-94.

*Laserline 6 Elite Maintenance Manual,* M-520604 Iss. 1. publ. by Oki Electric Industry Co., Ltd., Jan. 1988, pp. 3-21-3-23.

*Primary Examiner*—Joan H. Pendegrass
*Attorney, Agent, or Firm*—Spencer, Frank & Schneider

[57] ABSTRACT

A toner residual amount detecting mechanism comprises a stirring device and a photosensor. The photosensor has a protrusion, and rotates together with a stirring shaft while the protrusion contacts with a pin planted on the stirring shaft. The stirring device rotates by its gravity when it reaches a top dead point thereof. The stirring device also includes a magnetic rotor attracted by a permanent magnet in a sensor lever to thereby turn the sensor lever about the fulcrum of the sensor lever to a predetermined position. The sensor lever is stopped by a stopper when the stirring device reaches the bottom dead point thereof. The photosensor cannot detect light when the sensor lever is positioned at the bottom dead point since the light is intercepted by the sensor lever but can detect the light when the sensor lever reaches the predetermined position. The mechanism can inform an operator of a toner supply time since the photosensor operates depending on the resistance of toner against the stirring device.

6 Claims, 14 Drawing Sheets

TONER RESIDUAL AMOUNT DETECTING MECHANISM

BACKGROUND OF INVENTION

1. Field of the Invention

The present invention relates to a developing device used in a electrophotographic recording apparatus, particularly to a toner residual amount detecting mechanism of the device.

2. Description of the Related Art

Conventionally some developing devices used in the electrophotographic apparatus are provided with a toner residual detecting mechanism, which rotates a supported stirring shaft extending in the longitudinal direction of a hopper which stores toner supplied thereto, transmits the resistance of the residual toner to the rotor provided on the stirring shaft, and detects the operation of the rotor by a photosensor. For example, such a typical developing device is disclosed in a maintenance manual entitled "Laser Line TM 6 elite" pp 3–21 to 22, published by Oki Electric Industry Co., Ltd. in January 1988. This developing device will be described hereinafter with reference to the drawings.

FIG. 2 is a cross-sectional view of a toner residual amount detecting mechanism of the developing device.

The developing device 1 comprises a hopper portion 3 for storing toner 2 supplied thereto, a developing roller 5, a supply roller 6, and a stirring shaft 7 which extend in the longitudinal direction of the portion 3 and is rotatably supported by both side portions of a frame 4, and a blade portion 8 which extends along the surface of the developing roller 5 in the axial direction thereof. The developing roller 5, the supply roller 6 and the stirring shaft 7 each have one end extending out of one side portion of the frame 4 and being connected to a gear. Each of the gears meshes an intermittent gear, not shown, to thereby form a chain of gears. As illustrated in FIG. 3A, the gear 11 coupled to the stirring shaft 7 has a stepped portion 11*a* and contacts a rotor 12 which rotates together with the gear 11. The stepped portion 11*a* and the rotor 12 have substantially the same radius. The stirring shaft 7 is fixed to the rotor 12 at one end thereof and the gear 11 is rotatable relative to the stirring shaft 7. The gear 11 and the rotor 12 can be rotatable relative to each other by engaging a stopper 15 provided on the gear 11 into a long slit 14 provided in the rotor 12 and engaging a protrusion 16 provided on the rotor 12 into a long slit 13 provided in the gear 11 wherein the long slits 13 and 14 are arc-shaped relative to the centers of the gear 11 and the rotor 12. An extension spring 18 stretches across a protrusion 17 provided on the gear 11 and the protrusion 16 provided on the rotor 12 so that the stopper 15 of the gear 11 is brought into contact with one end of the long slit 14. At this state, the concave portion 19 provided on the gear 11 is positioned to overlap the concave portion 20 provided on the rotor 12. The developing roller 5 contacts a photoconductor drum 22 as illustrated in a two dot chain line in FIG. 2. The stirring shaft 7 has a stirring device 21 for the toner 2 in the hopper portion 3 for preventing the toner 2 from lumping in the hopper portion 3.

FIGS. 3A and 4A show the state where the toner 2 is stored in the hopper portion 3 while FIGS. 3B and 4B show the state where the toner 2 is not stored in the hopper portion 3.

A sensor lever 23 has a fulcrum 24 at one end thereof, an extension spring 25 provided at the other end thereof and a convex portion 23*a* provided at the substantially central portion thereof. The convex portion 23 of the sensor lever 23*a* of contacts the stepped portion 11*a* and the outer periphery of the rotor 12 by resiliency of the extension spring 25. A protrusion 23*b* of the sensor lever 23 is retained by a microswitch 26 provided in the developing device.

An operation of the developing device will be described hereinafter.

Since the gear of the developing roller 5 meshes a gear, not shown, for driving the photoconductor drum 22, the developing roller 5, the supply roller 6 and the stirring shaft 7 are rotated in the directions of the arrows B, B and D respectively when the photoconductor drum 22 rotates in the direction of the arrow C as shown in FIG. 2. The toner 2 charged with electricity on the surface of the developing roller 5 is uniformly layered and attached thereon by the blade 8. The toner 2 adheres to an electrostatic latent image formed on the photoconductor drum 22 which rotates at constant speed in the direction of the arrow C and visualizes the electrostatic latent image. At this time, the stirring device 21 rotates together with the stirring shaft 7 in the direction of the arrow D so that the toner 2 is conveyed to the supply roller 6 and it stirs the toner 2 for preventing the toner 2 from lumping therein.

When the residual amount of the toner 2 is sufficiently large in the hopper portion 3, the resistance of the toner 2 applied to the stirring device 21 is high so that the extension spring 18 stretches as illustrated in FIG. 4A in which the rotary force of the gear 11 is transmitted to the rotor 12 to thereby rotate the stirring shaft 7 in the direction of the arrow D while the other end of the long slit 14 of the rotor 12 is in contact with the stopper 15 of the gear 11. At this time, since the concave portion 20 of the gear 11 does not overlap the concave portion 19 of the rotor 12, the sensor lever 23 does not turn so that the microswitch 26 attached to the developing device does not operate. When the residual amount of the toner 2 stored in the hopper portion 3 is small, the resistance of the toner 2 acting on the stirring device 21 becomes weak. The extension spring 18 contracts and transmits the rotary force of the gear 11 to the rotor 12 while one end of the long slit 14 of the rotor 12 is in contact with the stopper 15 of the gear 11 as illustrated in FIG. 4B. As a result, the stirring shaft 7 is rotated in the direction of the arrow D. At this time, the concave portion 20 of the gear 11 overlaps the concave portion 19 of the rotor 12 so that the sensor lever 23 turns when the convex portion 23*a* of the same enters the concave portions 19 and 20 whereby the protrusion 23*b* of the sensor lever 23 operates the microswitch 26. In the series of the operations, the residual amount of the toner 2 in the hopper portion 3 is detected.

However, there is the following drawback in the conventional toner residual amount detecting mechanism. When the resistance of the toner to the stirring device is sufficiently high, the extension spring stretches to thereby cause the stopper provided on the gear to be brought into contact with the other end of the long slit provided in the rotor whereby the microswitch does not operate. On the contrary, when the resistance of the toner to the stirring device is low, there occurs an unstable situation where the extension spring contracts so that the stopper provided on the gear is brought into contact with neither one end nor the other end of the long slit provided in the rotor. Resistance received from the toner is varied in proportion to the depth to which the stirring device enters the toner, the stopper vibrates in the long slit in such a situation. At this time, the concave portions of both the gear and the rotor overlap each other to thereby operate the sensor lever.

SUMMARY OF THE INVENTION

It is an object of the present invention to provide a toner residual amount detecting mechanism capable of performing a stable detecting operation even if the resistance of the toner is low to thereby inform an operator of a correct toner supply time.

To achieve the above object, the toner residual amount detecting mechanism according to a first aspect of the present invention includes a hopper, a stirring shaft, a rotor located in the hopper, a photosensor, a pin planted on the stirring shaft and a stopper located outside the hopper wherein the photosensor detects the rotation of the rotor together with the stirring shaft in the hopper so as to attract a sensor lever. The rotor formed of a magnetic body has a first end retained by the stirring shaft, a second end provided adjacent to the wall of the hopper and retained by the stirring shaft. The second end has a protrusion which contacts with the side surface of the pin. The sensor lever is disposed outside the hopper and has one end on which a permanent magnet is provided and is capable of turning near to the locus of the magnetic body. The sensor lever also turns on or off the photosensor at a bottom dead point being as a first position. The stopper contacts with and stops the sensor lever which turns together with the rotor to a second position wherein it turns on or off the photosensor.

When the stirring shaft in the toner residual amount detecting mechanism is rotated, the rotor can rotate together with the stirring shaft since the one end of the pin brought into contact with the protrusion of the rotor. When the rotor reaches the top dead point, it falls down faster than the stirring shaft by its gravity. At the time. the other end of the magnet rotor receives the resistance from the toner, depending on the presence of the toner in the hopper portion so that the stop position of the rotor is varied. As a result, the time during which the sensor lever turns the photosensor ON or OFF, is varied. It is possible to detect the accurate toner supply time by comparing this ON or OFF time with another or reference ON or OFF time. According to the first aspect of the present invention, it is possible to detect the presence of the toner without using the spring and to provide the toner residual amount detecting mechanism capable of performing a stable operation.

To achieve the same object, the toner residual amount detecting mechanism according to the second aspect of the present invention comprises a stirring shaft, a guide pin disposed on the central portion of the stirring shaft crossing the stirring shaft at right angles thereto, a rotor having a C-shape in cross section and extending in the axial direction of the stirring shaft, the rotor having a slot provided in the circumferential direction of the central portion thereof, the slot being freely engaged with one end of the guide pin so as to constitute a turning pair together with the stirring shaft, a reset spring extending in the axial direction of the stirring shaft and having both ends respectively slidably held by both ends of the rotor and a central portion which brings into contact with the peripheral surface of the other end of the guide pin so as to bias the rotor and cause one end of the slot to bring into contact with one end of the guide pin, and an actuator having one end fixed to a sensor shaft which is rotatably supported in parallel with the stirring shaft and another end extending toward the stirring shaft so as to cross the stirring shaft and being in contact with the central portion of the rotor.

When the toner remains in the hopper portion, the rotor rotated together with the stirring shaft receives the resistance from the toner and rotates against the resiliency of the reset spring until it is contacted with the one end of the slot along the one end of the guide pin. At this time, the other end of the guide pin is positioned on the chord side of the crescent-shaped rotor. Since the other end of the actuator is brought into contact with the rotor and the other end of the guide pin during one revolution of the stirring shaft, the actuator cannot turn so that the sensor shaft coupled to the actuator cannot turn so or off the photosensor. Meanwhile, when the hopper portion is empty of the toner, the rotor does not turn since it does not receive the resistance from the toner, whereby the guide pin is in parallel with the chord of the crescent-shaped rotor. When the other end of the actuator is positioned at the chord side of the crescent-shaped rotor, the rotor turns so that the sensor shaft coupled to the actuator turns on or off the photosensor since the actuator is not impeded in the turning thereof by the rotor and the guide pin. Accordingly, it is possible to detect the toner supply time.

According to the second aspect of the invention, since the spring can stretch in the axial direction of the stirring shaft, the spring constant can be set in conformity with the resistance of the toner. As a result, it is possible to provide a toner residual amount detecting mechanism capable of stable operation.

DESCRIPTION OF THE PREFERRED EMBODIMENT

Figure 1:
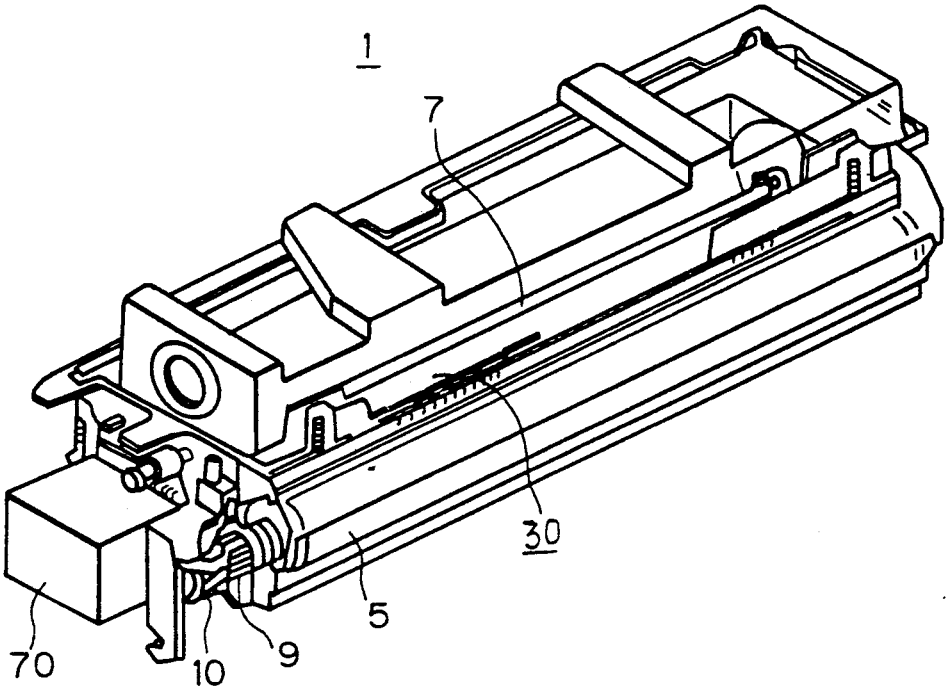
FIG. 1 is a perspective view showing the structure of a developing device including a toner residual amount detecting mechanism according to the present invention.
Figure 2:
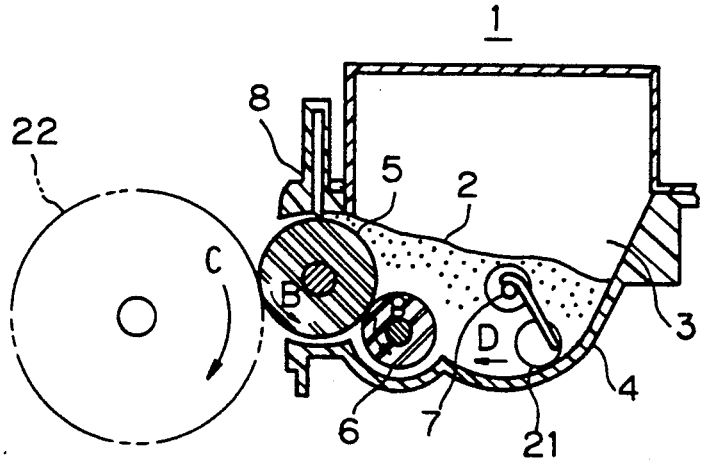
Fig. 2 (RELATED ART)
FIG. 2 is a cross-sectional view showing the structure of a conventional developing device.
Figure 3A:
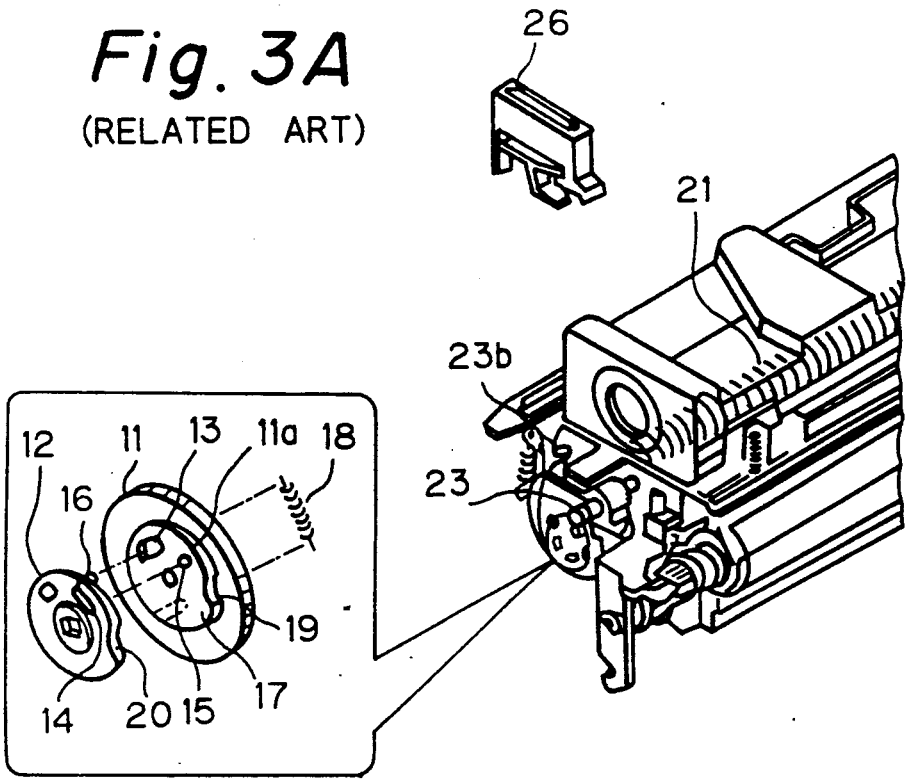
Fig. 3A (RELATED ART)
FIGS. 3A and 3B are views showing the operation of the photosensor of the conventional toner residual amount detecting mechanism.
Figure 3B:
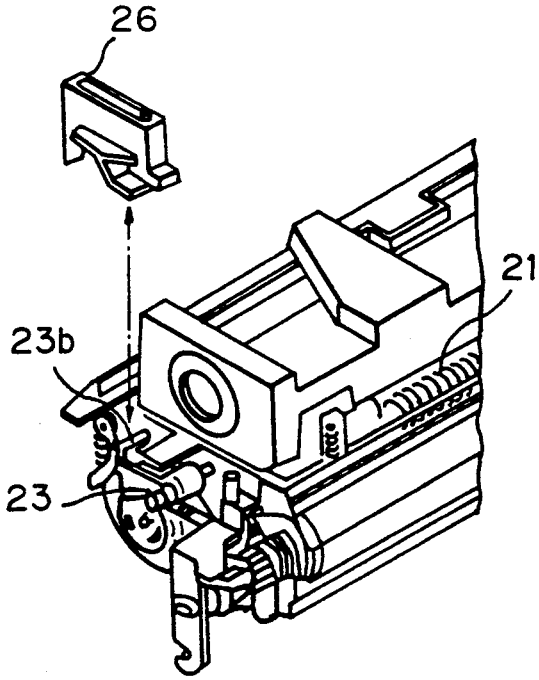
Fig. 3B (RELATED ART)
Figure 4A:
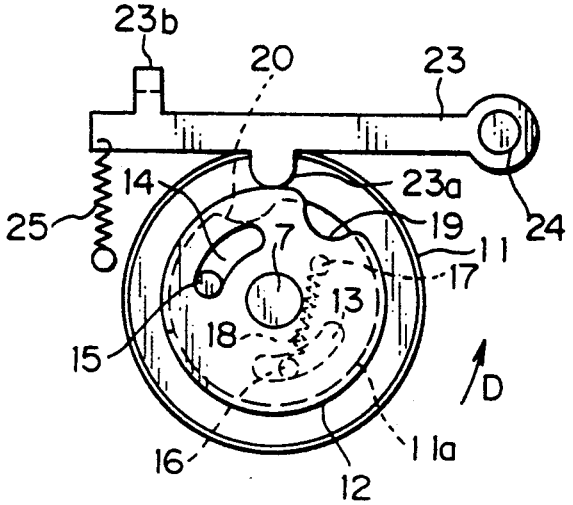
Fig. 4A (RELATED ART)
FIGS. 4A and 4B are views showing the relation between the sensor lever of the conventional toner residual amount detecting mechanism and the rotor of the same.
Figure 4B:
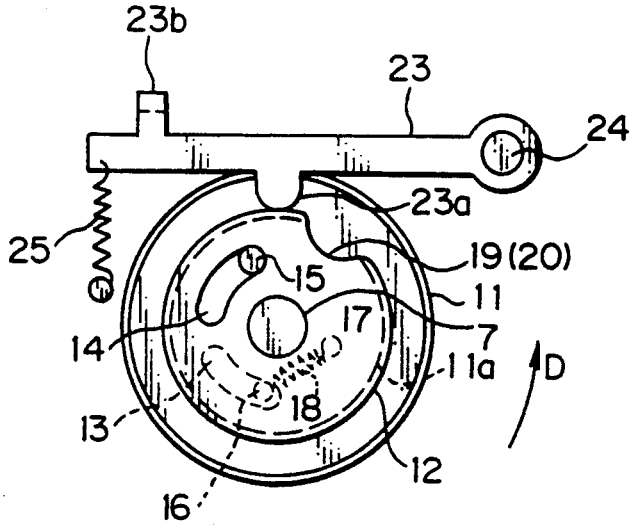
Fig. 4B (RELATED ART)

A toner residual amount detecting mechanism according to the present invention will be described with reference to FIG. 1 and FIGS. 5 to 15. FIG. 1 is a perspective view showing the structure of a developing device provided with a toner residual amount detecting mechanism according to the present invention.

In FIG. 1, a developing device 1 comprises a developing roller 5, gears 9 and 10, a stirring device 30 for stirring toner 2 stored in the hopper portion to prevent the toner 2 from lumping and a photo sensing mechanism 70 (not shown precisely in shape). As illustrated in FIG. 1, the toner residual amount detecting mechanism is attached to one end of the developing device 1.

First Embodiment (FIGS. 5 to 10)

A toner residual amount detecting mechanism according to the first embodiment will be described with reference to FIGS. 5 to 10.

Figure 5:
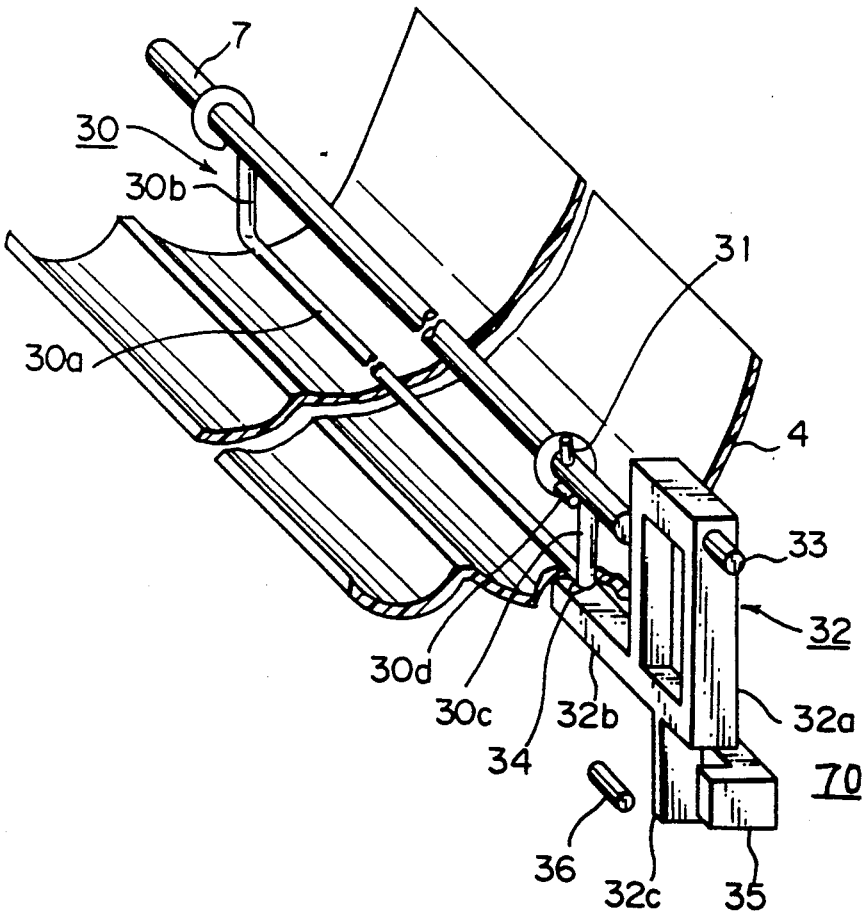
FIG. 5 is a perspective view showing a schematic arrangement of a main portion of the toner residual amount detecting mechanism according to a first embodiment of the present invention.

FIG. 5 is a perspective view showing the schematic arrangement of a main portion of the toner residual amount detecting mechanism according to the first embodiment of the present invention.

Elements which are common to the first and second embodiments of the present invention are denoted at the same numerals.

In the toner residual amount detecting mechanism as illustrated in FIG. 5, both ends of a stirring shaft 7 are rotatably supported by side portions, not shown, of a frame 4. One end of the stirring shaft 7 extends to the outside of one side portion of the frame 4 and the other end thereof is fixed to a gear. A pin 31 is planted on the other end of the stirring shaft 7. The stirring device 30 serving as a rotor is formed of, e.g., a round iron rod or other appropriate magnetic material and has a U-shaped configuration comprising a body 30*a*, arms 30*b* and 30*c*. Both ends of the arms 30*b* and 30*c* are rounded so as to be rotatable around the stirring shaft 7. A protrusion 30*d* is provided at the end of the arm 30*c* and the second end of the arm 30*c* is adjacent to the wall of the hopper. The protrusion 30*d* is parallel with the stirring shaft 7 and formed so as to be in contact with the pin 31. In the photo sensing mechanism 70, a sensor lever 32 formed of synthetic resin etc. is light in weight and has a substantially L-shaped configuration comprising a body 32*a* and an arm 32*b*. The sensor lever 32 is provided outside the frame 4. A rotary fulcrum 33 is provided at one end of the body 32*a* of the sensor lever 32 which is in parallel with the stirring shaft 7 and is turnable relative to the developing device. A shading portion 32*c* is provided at the other end of the body 32*a* to turn on or off a photosensor 35 fixed to the developing device. A stopper 36 fixed to the developing device restricts the turning range of the sensor lever 32. A permanent magnet 34 is embedded in the tip end of the arm 32*b*, and is positioned outside the frame 4.

Figure 6A:
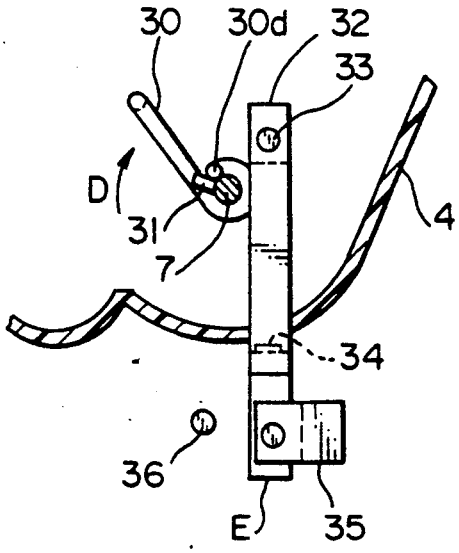
FIGS. 6A and 6B are side views showing the relation between the stirring device and the sensor lever of the toner residual amount detecting mechanism of FIG. 5.
Figure 6B:
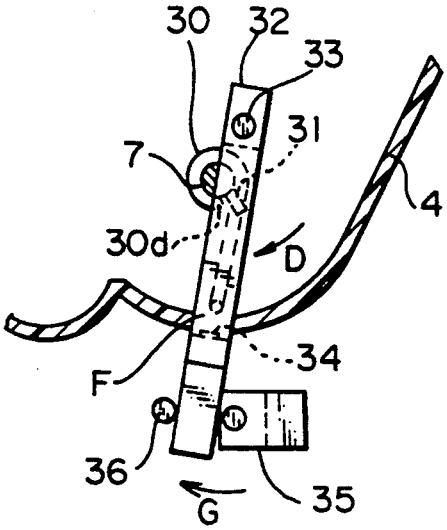

FIGS. 6A and 6B are respectively side views showing the relationship between the stirring device and the sensor lever. FIG. 6A shows the state where the pin 31 on the stirring shaft 7 rotates the stirring device 30 in the direction of the arrow D from the bottom dead point while the pin 31 is in contact with the protrusion 30*d*. At this state, the sensor lever 32 intercepts the light between the light emitting element and light receiving element of the photosensor 35 at the bottom dead point E, serving as the first position, to turn off the photosensor 35. FIG. 6B shows the state where the body 30*a* of the stirring device 30, which rotates in the direction of the arrow D, reaches the position closest to a permanent magnet 34 of the sensor lever 32 as illustrated in FIG. 6A and thereafter reaches the bottom dead point F of the stirring device 30 serving as the second position. At this state, the sensor lever 32 is turned in the direction of the arrow G and is brought into contact with the stopper 36 of the developing device since the permenent magnet 34 is attracted by the stirring device 30. As a result, the light receiving element receives the light emitted from the light emitting element so that the photosensor 35 turns on.

Figure 7A:
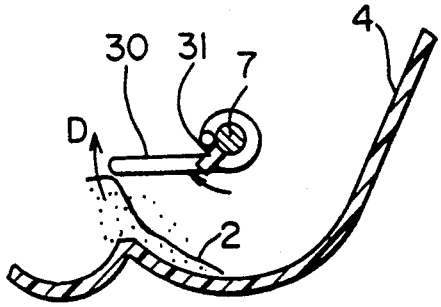
FIGS. 7A to 7C are views showing the operation of the stirring device when a toner hopper portion is empty of toner.
Figure 7B:
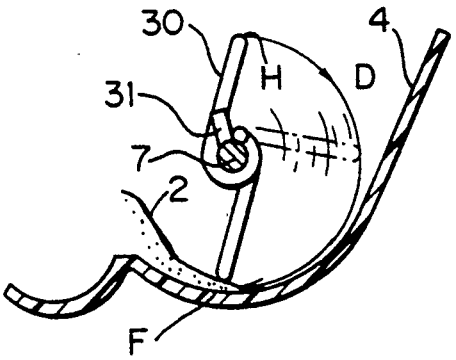
Figure 7C:
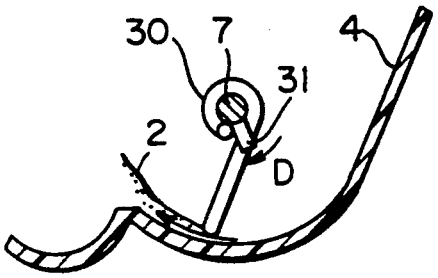

FIGS. 7A to 7C are views showing the operation of the stirring device when the toner hopper portion is empty of the toner. In FIG. 7A, the stirring device 30 rises from the bottom dead point thereof by the rotation of the stirring shaft 7 in the direction of the arrow D while it is in contact with the pin 31. In FIG. 7B, the stirring device 30 reaches a top dead point H and thereafter reaches the bottom dead point F by its gravity faster than the stirring shaft 7 since the amount of the toner 2 is small. In FIG. 7C, the pin 31 of the stirring shaft 7 is brought into contact again with the stirring device 30 which has been stopped at the bottom dead point F.

Figure 8A:
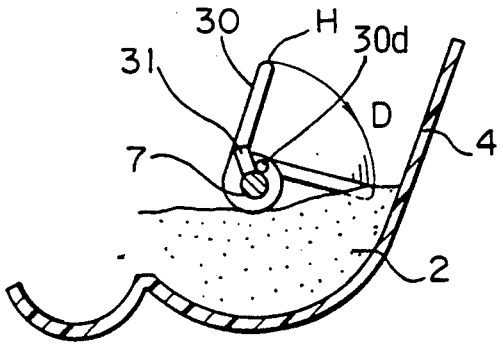
FIGS. 8A and 8B are views showing the operation of the stirring device when the toner remains in the toner hopper portion.
Figure 8B:
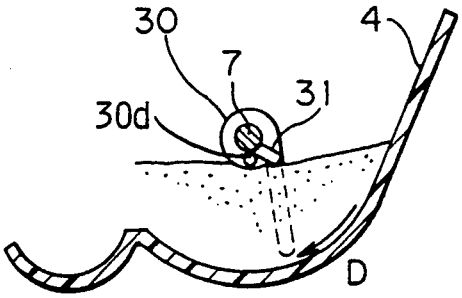

FIGS. 8A and 8B are views showing the operation of the stirring device when the toner remains in the toner hopper portion. In FIG. 8A, the stirring device 30 reaches the top dead point H and thereafter falls by its gravity to the surface of the toner 2 which remains half in a hopper portion 5. In FIG. 8B, after the protrusion 30*d* of the stirring device 30 is in contact with the pin 31, the stirring device 30 stirs the toner 2 by the rotation of the stirring shaft 7 in the direction of the arrow D from the state illustrated in FIG. 8A.

Figure 9:
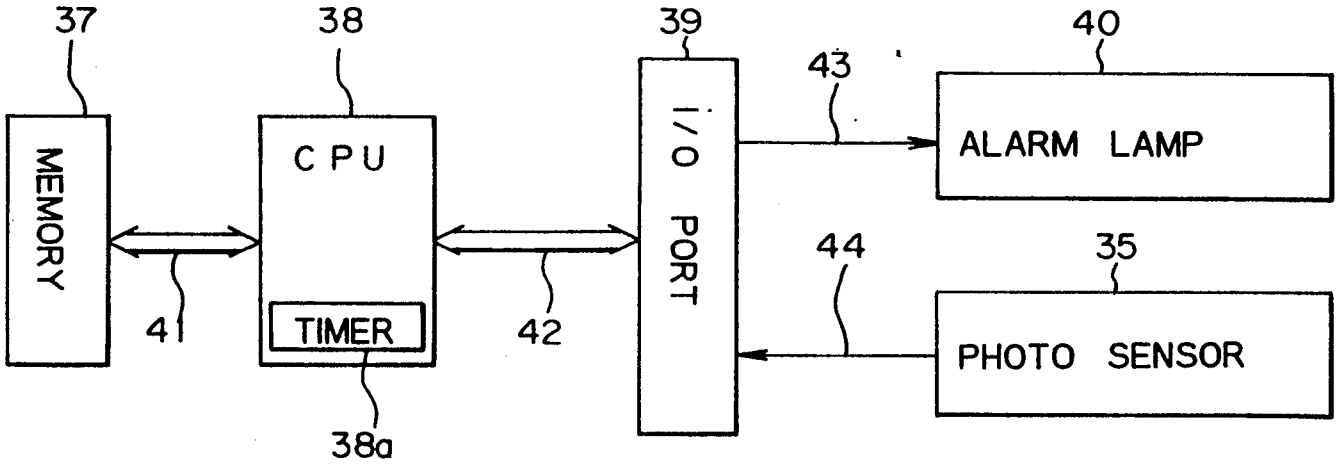
FIG. 9 is a block diagram showing the structure of the control portion of the toner residual amount detecting mechanism in FIG. 5.

FIG. 9 is a block diagram showing a structure of the control portion of the toner residual amount detecting mechanism according to the first embodiment.

A central processing unit 38 (hereinafter referred to as a CPU 38) is coupled to a memory 37 and an input/output port 39 by way of bus-lines 41 and 42. The photosensor 35 and an alarm lamp 40 are respectively coupled to the input/output port 39 by way of lines 43 and 44. The CPU 38 houses a timer 38*a* therein. The CPU 38 actuates the timer 38*a* upon reception of an OFF signal issued by the photosensor 35 so that the timer 38*a* counts the time until the photosensor 35 issues an ON signal. The CPU 38 compares a timer count value Tc counted by the timer 38*a* with a value Ts corresponding to the timer count value stored in the memory 37 at the time of supply of the toner and develops an alarm signal to the alarm lamp 40 when the expression of $Tc \leqq Ts$ is established.

Figure 10A:
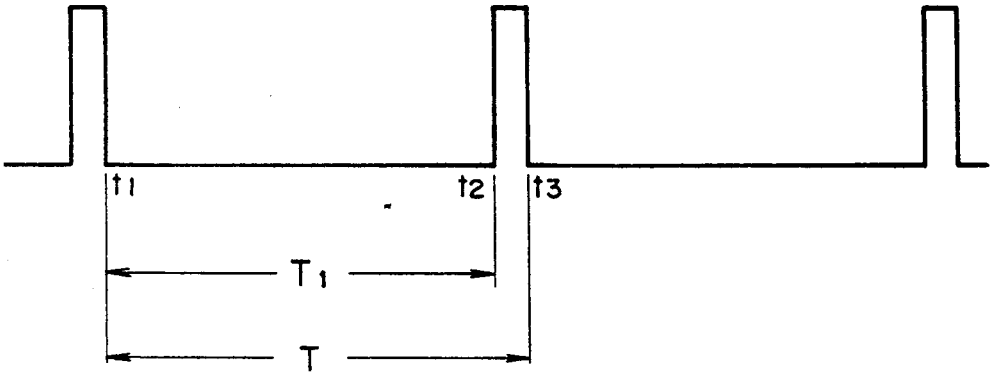
FIGS. 10A and 10B are timing charts of the mechanism in FIG. 5.
Figure 10B:
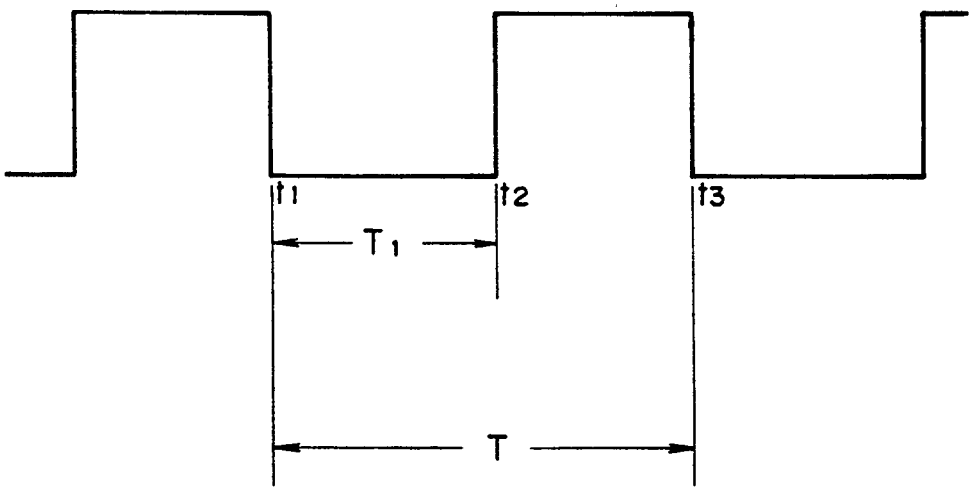

FIGS. 10A and 10B are timing charts of the mechanism according to the first embodiment. FIG. 10A shows the timing chart at the state where the toner remains in the toner hopper portion and FIG. 10B shows the timing chart at the state where the toner level is low in the toner hopper portion.

The time ranging from the time $t_1$ to $t_3$ shows a cycle T which represents one revolution of the stirring shaft 7 and a timer operation time $T_1$ ranging from the time $t_1$ to $t_2$ represents the interval during which the stirring device 30 is turned by the stirring shaft 7. During the time $T_1$, the sensor lever 32 is in the down position thereby turning OFF the photosensor 35.

An operation of the first embodiment will be described hereinafter.

When the stirring device 30 passes adjacent to the sensor lever 32 which is at rest at the bottom dead point E as illustrated in FIG. 6A, the sensor lever 32 is attracted to the stirring device 30 under the effect of the permanent magnet 34 and is deflected in the direction of the arrow G as illustrated in FIG. 6B. At this time, the photosensor 35 turns ON. Although the stirring device 30 rotates together with the stirring shaft 7, the sensor lever 32 is brought into contact with and stopped by the stopper 36 and thereafter returns to the bottom dead point E. At this time, the photosensor 35 turns OFF at the time $t_1$ as illustrated in FIGS. 10A and 10B. When the CPU 38 receives the OFF signal, it actuates the timer 38*a*. When the stirring device 30 passes again the bottom dead center E of the sensor lever 32 to thereby turn ON the photosensor 35 at the time $t_2$, the CPU 38 stops to actuate the timer 38*a*. Successively, the CPU 38 reads the timer count value Tc of the timer 38*a* and compares the timer count value Tc with the timer count value Ts stored in the memory at the time of supply of the toner. When the expression of $Tc \leqq Ts$ is established, the CPU 38 transmits the alarm signal to the alarm lamp 40 to thereby light the alarm lamp 40. Supposing that the toner hopper portion is full of the toner 2 as illustrated in FIGS. 8A and 8B, the stirring device 30 rises together with the stirring shaft 7 to the top dead point H and then rotates faster than the stirring shaft 7 by its gravity and thereafter stops at the surface of the toner 2. Successively, the stirring device 30 starts to rotate together with the stirring shaft 7 as illustrated in FIG. 8B. The operation at this stage is illustrated in the timing chart of FIG. 10A. The toner residual amount detecting mechanism completes one cycle, as illustrated in FIG. 10A, which starts at the time when the stirring device 30 rotates by its gravity from the top dead point H and ends at the time when the stirring device 30 gets over the bottom dead point E of the sensor lever 32. On the other hand, when the stirring device 30 rotates by its gravity from the top dead point H as illustrated in FIG. 7B and gets over the bottom dead point E of the sensor lever 32 while it does not receive the resistance of the toner 2, the timer operation time $T_1$ is shortened as illustrated in FIG. 10B. When the timer count value Tc during the timer operation time $T_1$ has a relation of $Tc \leqq Ts$ relative to the timer count value Ts stored in the memory 37 at the time of supply of the toner, the CPU 38 lights the alarm lamp 40 to thereby inform an operator of the need for toner.

According to the first embodiment, although the rotor comprises the stirring device 30 in U-shape formed with both arms 30*b* and 30*c* as a whole, an arm 30*c* alone may be formed as a rotor. The rotor may be also provided independently of the stirring device.

A Hall element can be used as a sensor instead of the photosensor. In this case, the permanent magnet should be fixed to the sensor lever.

Second Embodiment (FIGS. 11 to 14)

Figure 11:
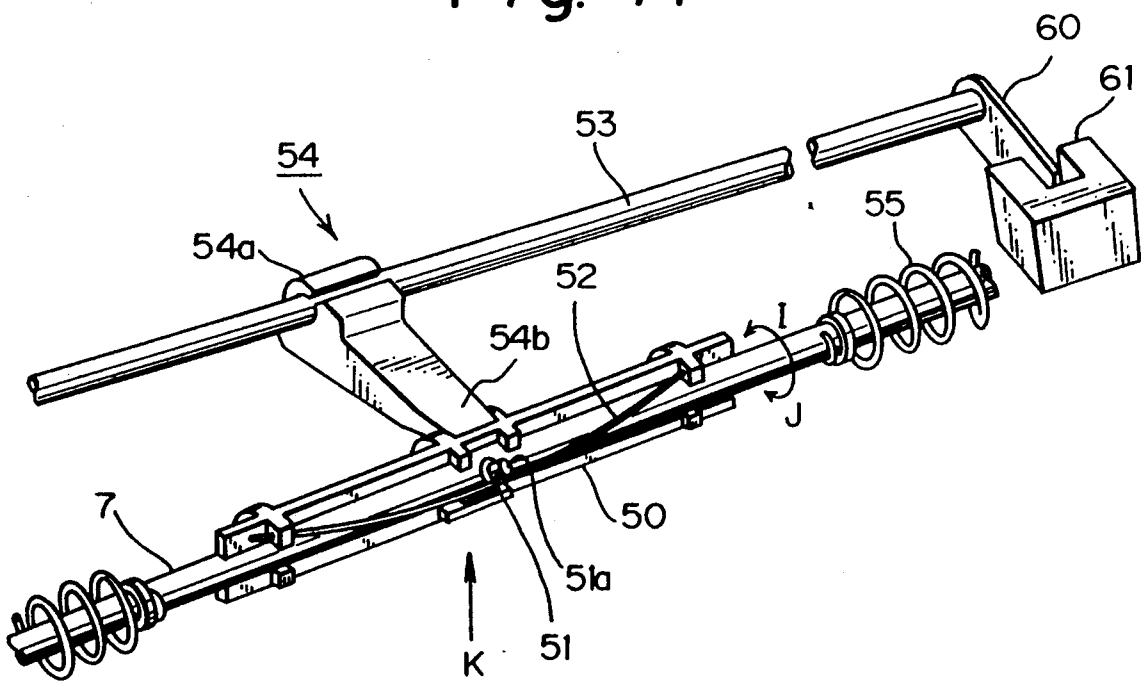
FIG. 11 is a perspective view showing a schematic arrangement of the main portion of a toner residual amount detecting mechanism according to a second embodiment of the present invention.

FIG. 11 is a perspective view showing a schematic arrangement of the main portion of the toner residual amount detecting mechanism according to the second embodiment of the present invention.

A sensor shaft 53 is rotatably supported by the side portion of the frame 4 and disposed in parallel with the stirring shaft 7. A guide pin 51 penetrates the central portion of the stirring shaft 7 so as to make a cross. A sensor member 50 as a rotor is turnably provided at the central portion of the stirring shaft 7 while the guide pin 51 serves as the guide for the sensor member 50. A reset spring 52 has both ends slidably supported by both ends of the sensor member 50 and a central flexible portion which is in contact with one end 51*a* of the guide pin 51. When the sensor member 50 turns in the direction of the arrow I, the reset spring 52 twists and flexes so as to return the sensor member 50 in the direction of the arrow J. An actuator 54 has one end 54*a* which is fixed to the sensor shaft 53 and the other end 54*b* which is in contact with the central portion of the sensor member 50. A sensor lever 60 is fixed to one end of the sensor shaft 53 which extends out of the hopper and turns on and off a photosensor 61 in response to the rotation of the actuator 54.

Figure 12:
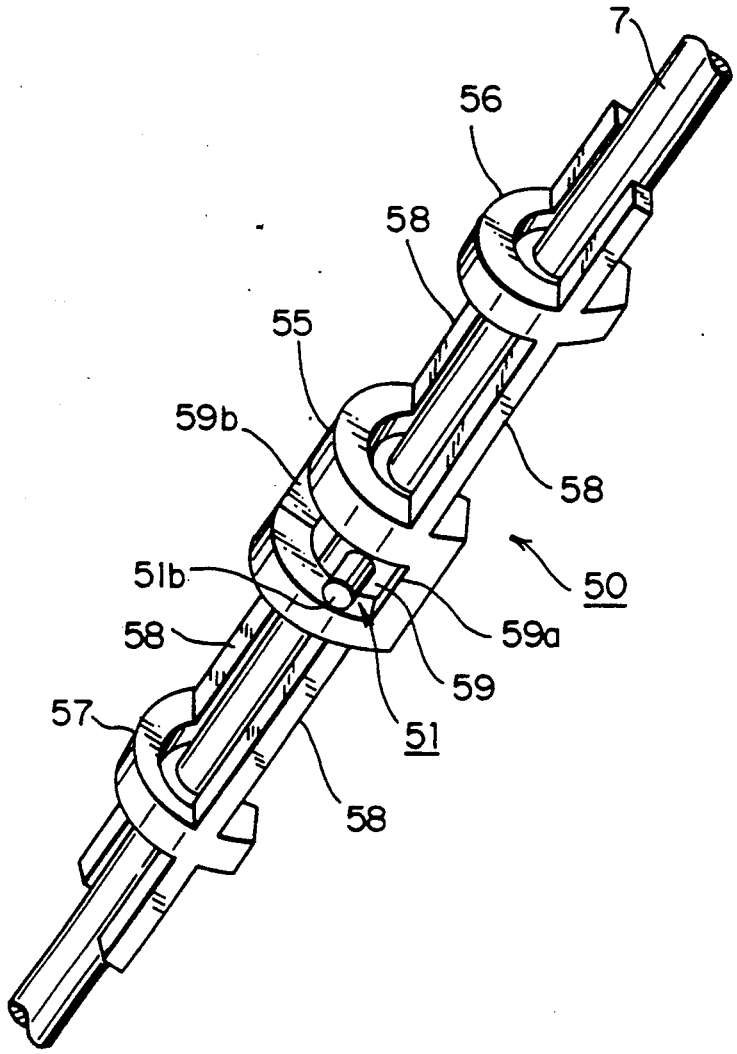
FIG. 12 is a perspective view showing the structure of a sensor member viewed in the direction of the arrow K in FIG. 11.

FIG. 12 is a perspective view of the sensor member 50 as viewed from the direction of the arrow K in FIG. 11. The sensor member 50 includes a central portion 55, both ends 56 and 57 and arms 58. The arms 58 for coupling the central portion 55 with the both ends 56 and 57 are disposed symmetrically with each other relative to the stirring shaft 7. The central portion 55 and both ends 56 and 57 have C-shapes in cross section. A slot 59 is provided at the central portion 55 so as to guide rotatably the other end 51*b* of the guide pin 51. The central portion 55 constitute a turning pair together with the stirring shaft 7. The other end 51*b* of the guide pin 51 is brought into contact with one end 59*a* of the slot 59 when it is reset by resiliency of the reset spring 52. When the sensor member 50 is rotated together with the stirring shaft 7, it receives the resistance of the toner so that the other end 51*b* of the guide pin 51 is brought into contact with the other end 59*b* of the slot 59.

An operation of the second embodiment will be described hereinafter.

Figure 13A:
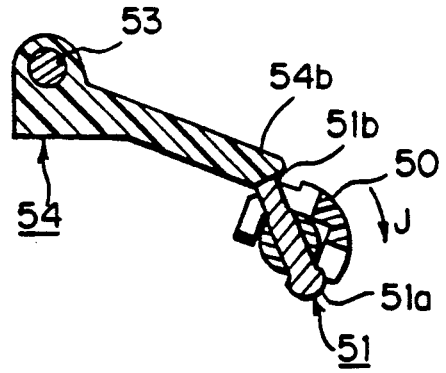
FIGS. 13A to 13D are views showing the operation of the toner residual amount detecting mechanism when the toner hopper portion is full of the toner.
Figure 13B:
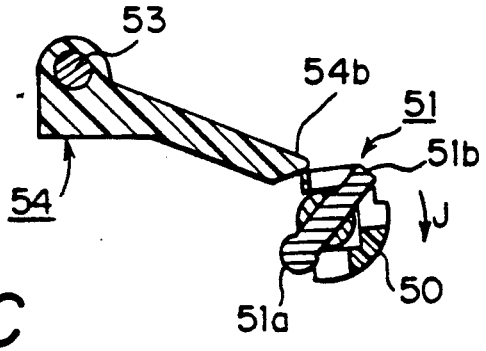
Figure 13C:
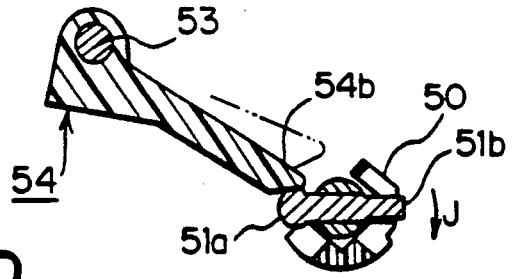
Figure 13D:
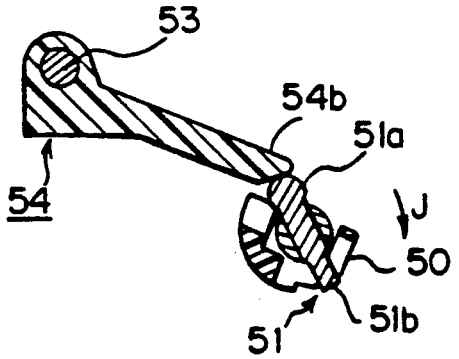

FIGS. 13A to 13D are views showing the operation of the mechanism when the hopper portion is full of the toner and the sensor member turns half in the direction of the arrow J. FIG. 13A shows the state where the other end 54*b* of the actuator 54 is in contact with the other end 51*b* of the guide pin 51 so that the photosensor 61 is OFF. FIG. 13B shows the state where the other end 54*b* of the actuator 54 is in contact with the sensor member 50. FIG. 13C shows the state where the other end 54*b* of the actuator 54 is in contact with one end 51*a* of the guide pin 51. A two dot chain line shows that the other end 54*b* of the actuator 54 is in the state as illustrated in FIG. 13B. FIG. 13D shows the state where the other end 54*b* of the actuator 54 is in contact with one end 51*a* of the guide pin 51. Successively, the other end 54*b* of the actuator 54 is in contact with a circular portion of the sensor member 50 and thereafter returns to the state as illustrated in FIG. 13A. That is, since the other end 54*b* of the actuator 54 does not turn to reach the bottom dead point, the sensor shaft 53 does not turn ON the photosensor 61 in any of the positions illustrated in FIGS. 13A to 13D.

Figure 14A:
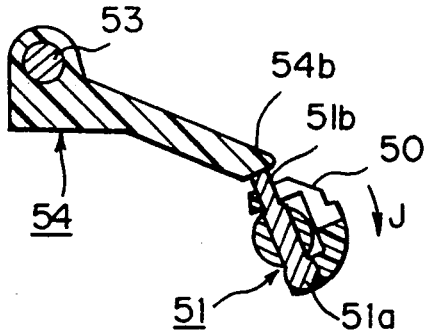
FIGS. 14A to 14C are views showing the operation of the toner residual amount detecting mechanism when the toner hopper portion is empty of the toner.
Figure 14B:
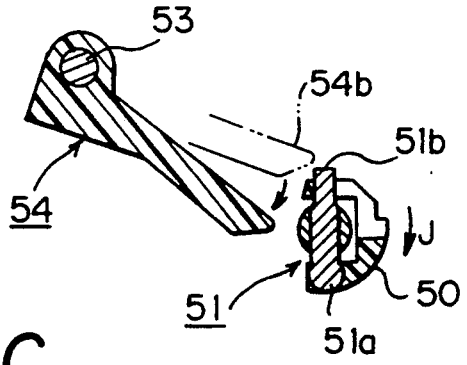
Figure 14C:
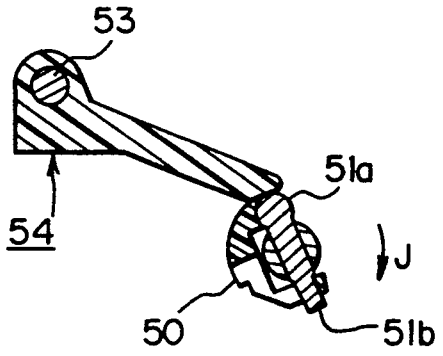

FIGS. 14A to 14C are views showing the operation of the mechanism when the toner hopper portion is empty of the toner, the sensor member turns half in the direction of the arrow J. FIG. 14A shows the same state as that in FIG. 13A. FIG. 14B shows the state where the other end 54*b* of the actuator 54 turns to reach the bottom dead point to thereby turn ON the photosensor 61. FIG. 14C shows the state where the actuator 54 which had turned to reach the bottom dead center was again brought into contact with one end 51*a* of the guide pin 51 and thereafter has returned to the position as illustrated in FIG. 14A. Thereafter, the other end 54*b* of the actuator 54 is brought into contact with the circular portion of the sensor member 50 and returns to the state as illustrated in FIG. 14A.

The sensor member according to the second embodiment operates not only to detect the residual amount of the toner but to stir the toner.

Figure 15:
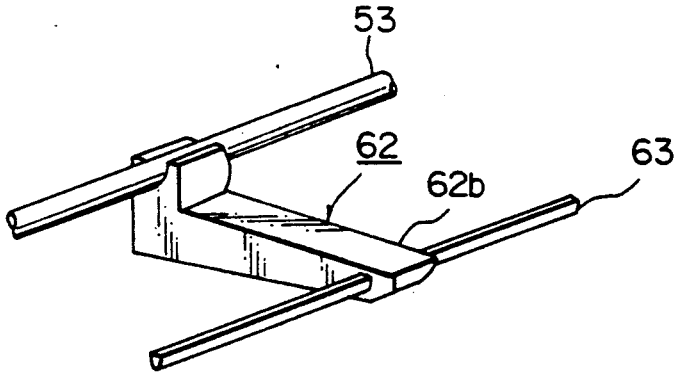
FIG. 15 is a perspective view showing a modified actuator according to the second embodiment.

Modification of Second Embodiment (FIG. 15)

According to the second embodiment, the width of the actuator is substantially the same as the width of the central portion of the sensor member. However, a stirring bar 63 may be provided at the other end 62*b* of an actuator 62 which is arranged over the whole length of the sensor member as illustrated in FIG. 15. In this case, when the actuator 62 moves up and down in accordance with the rotation of the sensor member, the stirring bar 63 collapses the toner located adjacent to the sensor member 50 whereby the toner is prevented from hollowing around the periphery of the sensor member 50.

What is claimed is:

1. In a toner residual amount detecting mechanism suitable for a developing device, wherein a photosensor detects the rotation of a rotor which rotates together with a stirring shaft in a hopper to indicate a toner supply time, said mechanism comprising:

a pin which is planted in the stirring shaft;

a rotor having a first end retained rotatably by the stirring shaft, a second end extending adjacent to the wall of the hopper and being formed with a magnetic material, the first end having a protrusion which is contacted with the side surface of the pin;

a sensor lever disposed outside the hopper and having one end on which a permanent magnet is provided and turning adjacent to the locus of the magnetic material, the sensor lever turning on or off a photosensor at a bottom dead point thereof; and a stopper for stopping the sensor lever which turns together with the rotor to a second position where it turns on or off the photosensor.

2. A toner residual amount detecting mechanism according to claim 1, wherein said rotor comprises an arm which is supported rotatably on said stirring shaft and is mounted with a magnetic material at one end thereof.

3. A toner residual amount detecting mechanism comprising:

a stirring shaft;

a guide pin disposed on the stirring shaft so as to make a cross therewith;

a rotor having a C-shape in cross section and extending in the axial direction of the stirring shaft, the rotor having a slot provided in the circumferential direction of the central portion thereof, the slot being freely engaged with one end of the guide pin so as to constitute a turning pair together with the stirring shaft;

a reset spring extending in the axial direction of the stirring shaft and having both ends respectively slidably held by both ends of the rotor and a central portion which brings into contact with the peripheral surface of the other end of the guide pin so as to bias the rotor and cause one end of the slot to bring into contact with one end of the guide pin; and an actuator having one end fixed to a sensor shaft which is rotatably supported in parallel with the stirring shaft and another end extending toward the stirring shaft so as to cross the stirring shaft and being in contact with the central portion of the rotor.

4. A toner residual amount detecting mechanism according to claim 3, wherein the roter has the central portion and both ends which are respectively C-shaped in cross section and coupled with one another by plate-shaped arms while the stirring shaft intervenes between the plate-shaped arms.

5. A toner residual amount detecting mechanism according to claim 3, wherein the actuator has a stirring bar at the other end thereof, the length of the stirring bar being equivalent to that of the rotor.

6. A toner residual amount detecting mechanism according to claim 4, wherein the actuator has a stirring bar at the other end thereof, the length of the stirring bar being equivalent to that of the rotor.

* * * * *